US007003244B2

(12) United States Patent
Cho

(10) Patent No.: US 7,003,244 B2
(45) Date of Patent: Feb. 21, 2006

(54) PRINTER HAVING MULTIFUNCTIONAL COVER

(75) Inventor: Young-bok Cho, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/939,397

(22) Filed: Sep. 14, 2004

(65) Prior Publication Data

US 2005/0031372 A1 Feb. 10, 2005

Related U.S. Application Data

(63) Continuation of application No. 10/256,205, filed on Sep. 27, 2002, now Pat. No. 6,807,392.

(30) Foreign Application Priority Data

Sep. 27, 2001 (KR) ..... 2001-60139

(51) Int. Cl.
*G03G 15/00* (2006.01)
*G03G 21/00* (2006.01)

(52) U.S. Cl. ..... 399/110; 399/13; 399/124

(58) Field of Classification Search ..... 399/110, 399/107, 124, 125, 13, 24, 111, 119, 120
See application file for complete search history.

(56) References Cited

U.S. PATENT DOCUMENTS

| | | | | |
|---|---|---|---|---|
| 4,739,367 | A | 4/1988 | Watanabe et al. | 399/111 |
| 4,903,076 | A | 2/1990 | Sakakibara | 399/124 |
| 5,134,443 | A | 7/1992 | Sumi et al. | 399/124 X |
| 5,398,098 | A | 3/1995 | Fukunaga et al. | 399/110 |
| 6,075,958 | A | 6/2000 | Gotoh et al. | 399/124 |
| 6,091,912 | A | 7/2000 | Kitajima et al. | 399/13 |
| 6,104,897 | A | 8/2000 | Ishizawa | 399/119 |
| 6,125,251 | A | 9/2000 | Shiraishi et al. | 399/124 |
| 6,324,351 | B1 | 11/2001 | Kurimoto et al. | 399/13 X |
| 2002/0041775 | A1 | 4/2002 | Ishii | 399/124 |

*Primary Examiner*—Sophia S. Chen
(74) *Attorney, Agent, or Firm*—Staas & Halsey LLP

(57) ABSTRACT

A printer has a cover which includes a jam removal lever position checking portion, a toner container locking lever position checking portion, a shutter switch, and a side cover bracket. The jam removal lever position checking portion interferes with a jam removal lever installed in the main body to check whether the jam removal lever is properly positioned. The toner container locking lever position checking portion interferes with a toner container locking lever installed in the main body to check whether a toner container is properly fixed. The shutter switch opens and closes a shutter to control a flow of remaining toner collected by a developer roller after being developed, into the toner container. The side cover bracket interferes with a side cover bracket installed at the main body to control joining a side cover with the main body.

21 Claims, 5 Drawing Sheets

PRINTER HAVING MULTIFUNCTIONAL COVER

CROSS-REFERENCE TO RELATED APPLICATION

This application is a continuation of U.S. application Ser. No. 10/256,205, now allowed. This application also claims the benefit of Korean Application No. 2001-60139, filed Sep. 27, 2001, in the Korean Intellectual Property Office, the disclosure of which is incorporated herein by reference.

BACKGROUND OF THE INVENTION

1. Field of the Invention

The present invention relates to a multi-function machine, and more particularly, to a multi-function machine having a multifunctional cover with a multi-function to control a proper operation of a plurality of devices installed in a main body of the multi-function machine.

2. Description of the Related Art

As office automation machines such as printers, copiers, scanners, and facsimiles are currently widespread, high-performance products are developed to expand original functions of these machines. As a result, a method of using the office automation machines becomes complicated, production cost goes up, and the office automation machines become high-priced pieces of equipment. Due to this, independent office automation machines have been combined into one machine to provide for a multi-function machine, which is economical and simple to use.

The multi-function machine has a structure in which a printer is combined with a facsimile machine. Thus, the multi-function machine has a printing device and a scanning device which copies a desired portion of an original through scanning. Also, the multi-function machine has an information transmission device, such as a modem, which stores and transceives data. Therefore, the multi-function machine is a single unit serving as a scanner and a copier as well as a printer and a facsimile machine.

FIG. 1 is a perspective view of a portion of a conventional office automation machine. Referring to FIG. 1, the office automation machine includes a main body 100, a multifunctional cover 200, a hook 220, and a protrusion 240. The multifunctional cover 200 is hinged to a bottom tip of the main body 100 and is to be opened from and closed toward the main body 100 using a hinge 120. The hook 220 is installed at one side of the multifunctional cover 200 so that it is joined with a knob 140 mounted at the main body 100 when the multifunctional cover 200 is closed toward the main body 100. The protrusion 240, which is installed at a portion of an inner surface of the multifunctional cover 200, turns off a switch 160 installed at the main body when the multifunctional cover 200 is opened from the main body 100 and turns on the switch 160 when the multifunctional cover 200 is closed toward the main body 100.

In the above-described configuration, the protrusion 240 is separated from the switch 160 when the multifunctional cover 200 is opened from the main body 100. Then, a supply of power to the main body 100 is cut off, and an operation of the multi-function machine stops. A device (not shown) installed in the main body 100 is therefore exposed so that it is replaced or repaired.

When the multifunctional cover 200 is closed toward the main body 100, the protrusion 240 is joined with the switch 160. Then, the main body 100 is supplied with power, and thus the device (not shown) installed therein is ready to operate.

As described above, the multifunctional cover 200 of the conventional office automation machine simply protects devices or parts therein. Also, power is cut off or supplied when the multifunctional cover 200 is opened from and closed toward the main body 100. Thus, additional devices are required to check whether or not devices in the main body 100 function properly. As a result, the conventional office automation machine is complicated and its cost becomes expensive.

SUMMARY OF THE INVENTION

Accordingly, it is an object of the present invention to provide a multi-function machine having a multifunctional cover to perform a function of checking whether or not devices in a main body operate properly as well as a function of supplying or cutting off power.

Additional objects and advantages of the invention will be set forth in part in the description which follows and, in part, will be obvious from the description, or may be learned by practice of the invention.

The foregoing and other objects of the present invention are achieved by providing a multi-function machine having a multifunctional cover with a power cutoff to cut off power of a main body when the multifunctional cover is opened from the main body and to supply the main body with power when the multifunctional cover is closed toward the main body to protect internal devices. The multifunctional cover, which is installed at a predetermined position facing the main body, includes a jam removal lever position checking portion, a toner container locking lever position checking portion, a shutter switch, and a side cover bracket. The jam removal lever position checking portion interferes with a jam removal lever installed in the main body to check whether the jam removal lever is properly positioned. The toner container locking lever position checking portion, which is adjacent to the jam removal lever position checking portion, interferes with a toner container locking lever installed in the main body to check whether a toner container is properly fixed. The shutter switch, which is adjacent to the toner container locking lever position checking portion, opens and closes a shutter to control a flow of remaining toner collected by a developer roller after being developed, into the toner container. The side cover bracket, which is installed at a predetermined position of the multifunctional cover facing the main body, interferes with a side cover bracket installed at the main body to control joining a side cover with the main body.

BRIEF DESCRIPTION OF THE DRAWINGS

The above and other objects and advantages of the invention will become apparent and more appreciated from the following description of the preferred embodiments, taken in conjunction with the accompanying drawings of which.

DETAILED DESCRIPTION OF THE PREFERRED EMBODIMENTS

Figure 1:
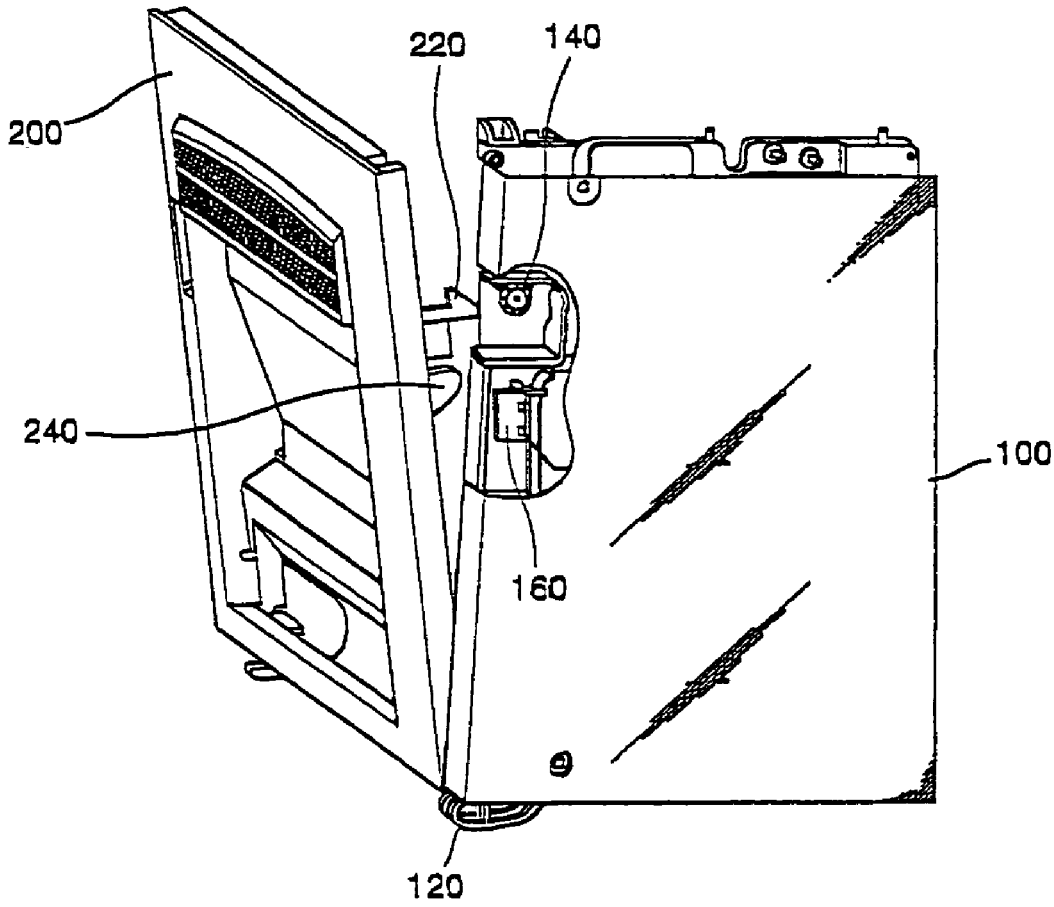
FIG. 1 (PRIOR ART)
FIG. 1 is a perspective view of a portion of a conventional office automation machine.
Figure 2:
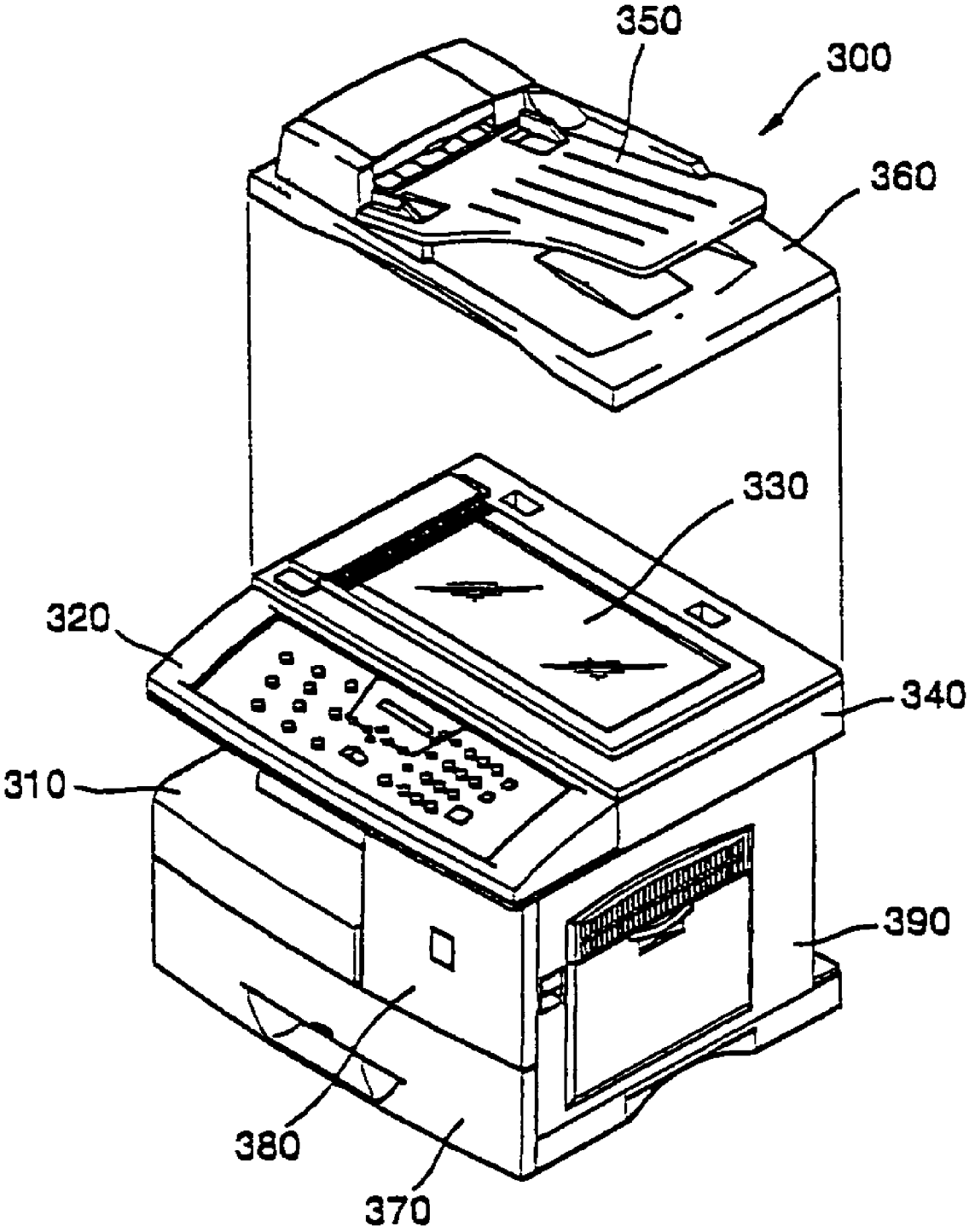
FIG. 2 is a perspective view of a multi-function machine adopting a multifunctional cover, according to an embodiment of the present invention.

FIG. 2 is a perspective view of a multi-function machine 300 adopting a multifunctional cover 380, according to an embodiment of the present invention. Referring to FIG. 2, the multi-function machine 300 includes a main body 310, a manipulation panel 320, a platen assembly 340, and a platen multifunctional cover assembly 360. The manipulation panel 320, which is installed at an upper part of the main body 310, provides an interface to operate the multi-function machine 300. The platen assembly 340 includes a scanning glass 330 through which light radiated by a scanner (not shown) penetrates. The platen multifunctional cover assembly 360 having a tray 350 supporting a copy, is hinged to an upper part of the platen assembly 340 by a hinge (not shown).

The multi-function machine 300 also includes a sheet feeding cassette 370, the multifunctional cover 380, and a side cover 390. Recording sheets are loaded into the sheet feeding cassette 370 which is installed at a lower part of the main body 310. The multifunctional cover 380, which is positioned at a front of the main body 310, has a plurality of members to grasp a position of an operation of devices installed in the main body 310. The side cover 390 is hinged to one side of the main body 310 and is used to inspect, replace, or protect devices installed in the main body 310.

Figure 3:
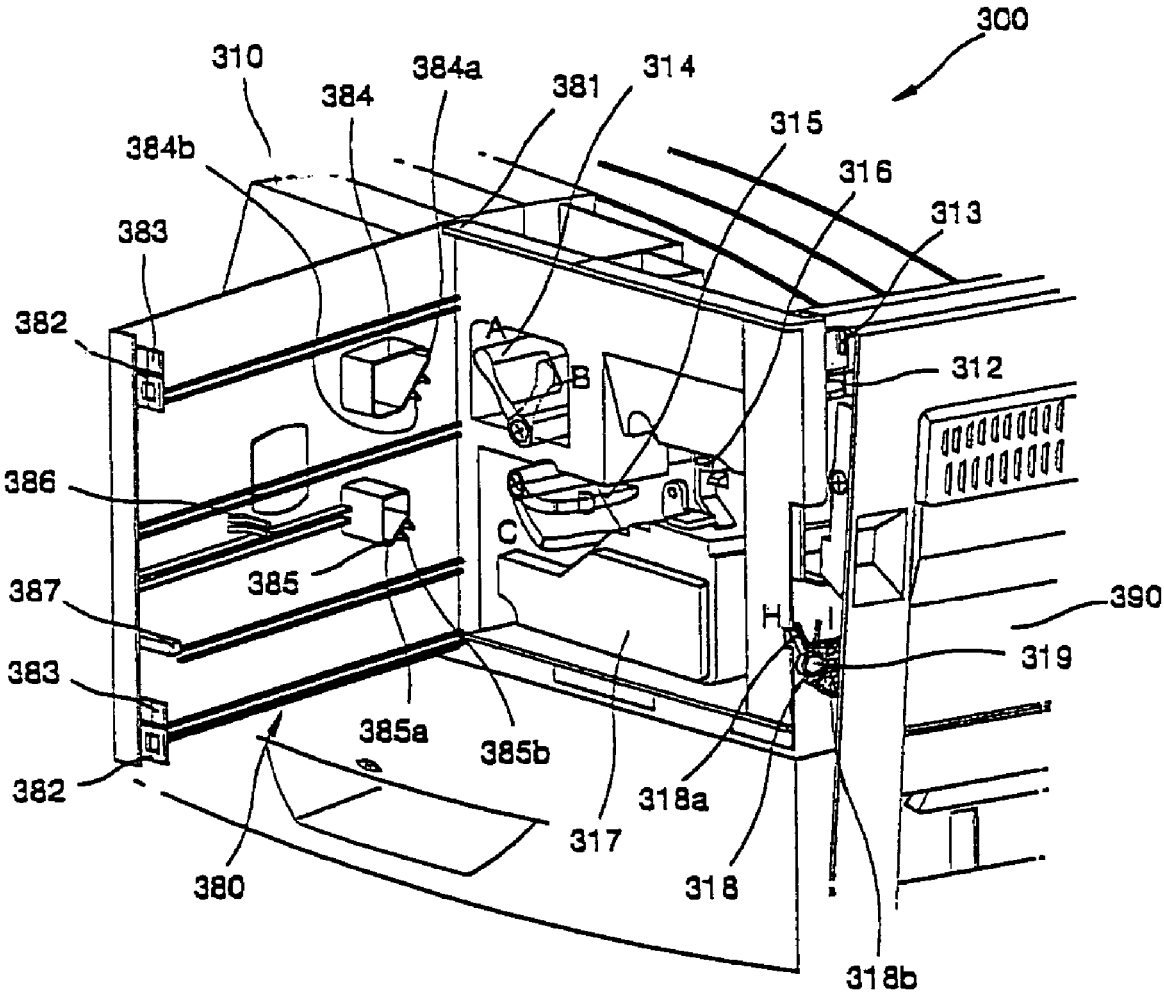
FIG. 3 is a perspective view showing the multifunctional cover shown in FIG. 2 in an open position from a main body.

FIG. 3 is a perspective view showing the multifunctional cover shown in FIG. 2 in an open opposition from a main body. Referring to FIG. 3, the multifunctional cover 380 is connected to the main body 310 by a hinge 381 so that it is opened from and closed toward the main body 310 using the hinge 381.

A locking unit 382 is provided at one side of the multifunctional cover 380 facing the main body 310, and a fixing unit 312 opposite to the locking unit 382 is provided in the main body 310. The locking unit 382 is joined with the fixing unit 312 when the multifunctional cover 380 is closed toward the main body 310. Thus, the multifunctional cover 380 is fixed to the main body 310.

A power cutoff device 383 may be installed at the multifunctional cover 380. The power cutoff device 383 serves as a safety device to suspend operations of devices by cutting off power of the main body 310 to protect the devices when the multifunctional cover 380 is opened from the main body 310. A switch 313, which faces the power cutoff device 383, is installed on the main body 310. The power cutoff device 383 turns on the switch 313 to supply the main body 310 with power when the multifunctional cover 380 is closed toward the main body 310. The power cutoff device 383 turns off the switch 313 to cut off the supply of power to the main body 310 when the multifunctional cover 380 is opened from the main body 310.

A jam removal lever position checking portion 384 is installed at a predetermined position of the multifunctional cover 380 facing the main body 310. The jam removal lever position checking portion 384 checks whether a jam removal lever 314, which is installed in the main body 310 to remove a jam occurring during the operation of the multi-function machine 300, is properly positioned.

The jam removal lever position checking portion 384 protrudes at a predetermined length from the multifunctional cover 380 toward the main body 310. A first inclined portion 384*a*, which interferes with the jam removal lever 314, is formed at one side of the jam removal lever position checking portion 384. A plurality of first ribs 384*b* are formed at the first inclined portion 384*a*.

The jam removal lever position checking portion 384 interferes with the jam removal lever 314 if the jam removal lever 314 is positioned at position B. The position B is a position to remove jams occurring during the operation of the multi-function machine 300 when the multifunctional cover 380 is joined with the main body 310. Here, the multifunctional cover 380 is not joined with the main body 310. However, a user may manually reposition the jam removal lever 314 at position A, and therefore allow the multifunctional cover 380 to come in contact with the main body 310.

The first ribs 384*b* push the jam removal lever 314 so that the multifunctional cover is joined with the main body 310 if the jam removal lever 314 is slightly spaced from the position A when the multifunctional cover 380 is joined with the main body 310. As a result, the jam removal lever 314 is exactly positioned at the position A.

The first ribs 384*b* serve to fix the jam removal lever 314 at the position A when the multifunctional cover 380 is joined with the main body 310. The user may open the multifunctional cover 380, position the jam removal lever 314 at position B, and remove the jam if a jam occurs during the operation of the multi-function machine 300.

A toner container locking lever position checking portion 385 is installed under the jam removal lever position checking portion 384 at a predetermined position of the multifunctional cover 380 facing the main body 310. The toner container locking lever position checking portion 385 checks whether a toner container locking lever 315 to join a toner container 317 with the main body 310 to fix the toner container 317 is properly fixed.

The toner container locking lever position checking portion 385 protrudes at a predetermined length from the multifunctional cover 380. A second inclined portion 385*a*, which interferes with the toner container locking lever 315, is provided at one side of the toner container locking lever position checking portion 385. A plurality of second ribs 385*b* are formed at the second inclined portion 385*a*.

The toner container locking lever position checking portion 385 is pressed against the toner container locking lever 315 if the toner container locking lever 315 is at position D when the multifunctional cover 380 is joined with the main body 310. Here, the multifunctional cover 380 interferes with the main body 310. Therefore, the user may position the toner container locking lever 315 at position C to prevent the toner container locking lever 315 from being interfered with the toner container locking lever position checking portion 385, and join the multifunctional cover 380 with the main body 310.

The second inclined portion 385*a* pushes the toner container locking lever 315 to fix it at position C when the multifunctional cover 380 is joined with the main body 310. Particularly, the second ribs 385*b* push the toner container locking lever 315 to be joined with the main body 310 if the toner container locking lever 315 is slightly spaced from the position C when the toner container locking lever position checking portion 385 is joined with the main body 310. Thus, the toner container locking lever 315 is exactly positioned at the position C.

The user may open the multifunctional cover 380, position the toner container locking lever 315 at the position D, and separate the toner container 317 from the main body 310.

Figure 4:
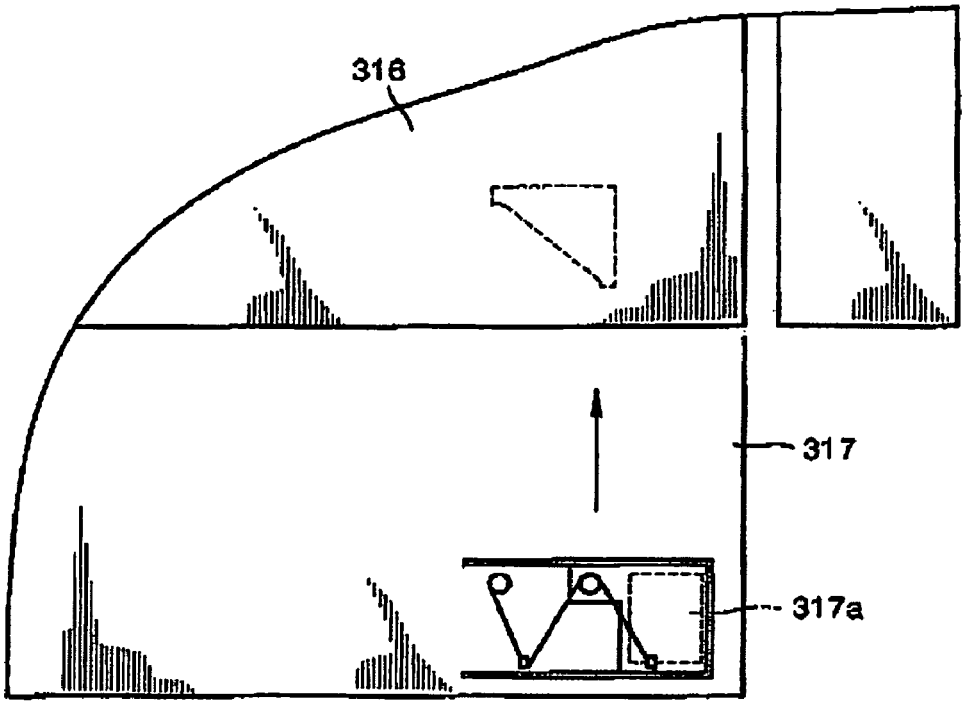
FIGS. 4 and 5 are views showing the states before and after the opening is open, respectively.
Figure 5:
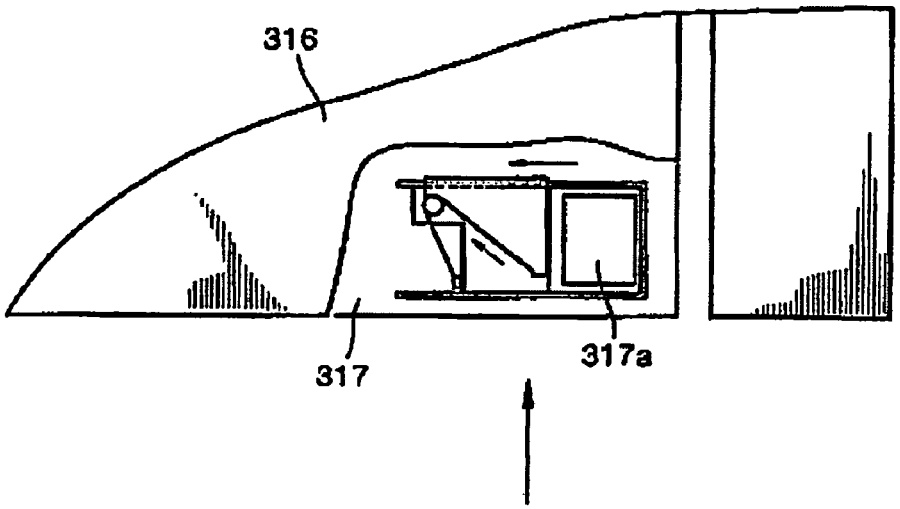

A shutter switch 386 adjacent to the toner container locking lever position checking portion 385 is provided at a predetermined position of the multifunctional cover 380 facing the main body 310. The shutter switch 386 serves to open and close a shutter 316*a* (FIGS. 6 and 7) so that toner collected from a developer unit 316 flows into the toner container 317. Referring to FIG. 4 and FIG. 5, an opening 317*a* is provided on the toner container 317 to face the shutter 316*a*. The opening 317*a* is opened when the toner container 317 is joined with the main body 310, and is closed when the toner container 317 is separated from the main body 310.

Figure 6:
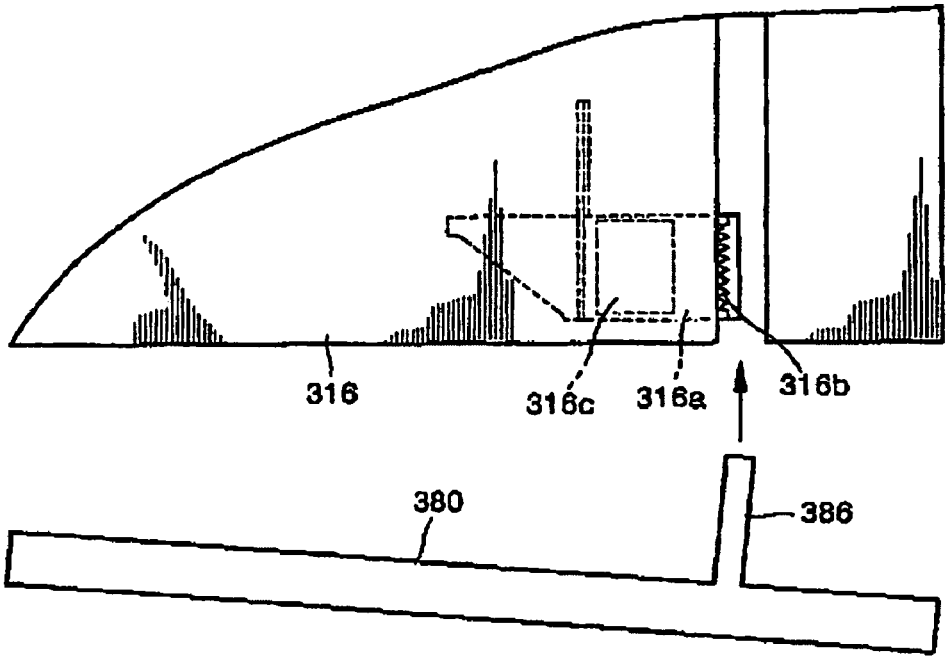
FIGS. 6 and 7 are views showing the states before and after the shutter is open, respectively.
Figure 7:
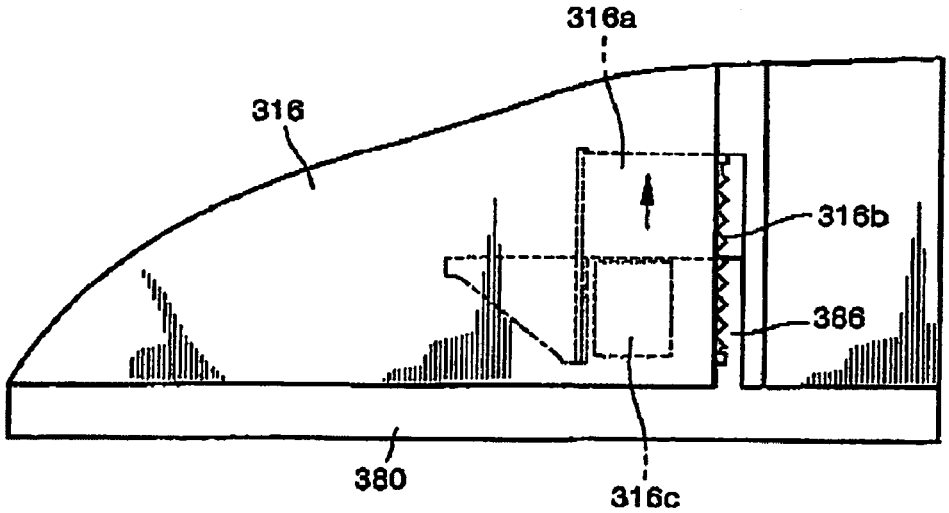

Referring to FIGS. 6 and 7, shutter 316*a* is positioned to correspond to the opening 317*a* of the toner container 317, and slides in an axial direction of the developer unit 316, and is elastically biased by an elastic device 316*b*.

The shutter switch 386 protrudes from the multifunctional cover 380 a predetermined length. The shutter switch 386 pushes the shutter 316*a* to open an outlet 316*c* when the multifunctional cover 380 is joined with the main body 310. As a result, the toner collected from the developer unit 316 flows into the toner container 317 through the opening 317*a*. In contrast, the shutter 316*a* is returned to the original position by an elastic force of the elastic device 316*b* so that the outlet 316*c* is closed and toner does not flow into the toner container 317 if the multifunctional cover 380 is opened.

A side cover bracket controller 387 is installed at a predetermined position of the multifunctional cover 380 facing the main body 310. The side cover bracket controller 387 interferes with a side cover bracket 318 installed at the main body 310 so that joining the side cover 390 with the main body 310 is controlled.

The side cover bracket 318 rotates a pivot 319 at the main body 310. An interferer 318*a* and a hinderer 318*b* are provided at a predetermined angle at the side cover bracket 318. The side cover bracket 318 is elastically biased to position H by an elastic device (not shown).

The side cover bracket controller 387 protrudes from the multifunctional cover 380 at a predetermined length. The side cover bracket controller 387 pushes the interferer 318*a*, and is joined with the main body 310 when the multifunctional cover 380 is joined with the main body 310.

The side cover bracket 318 rotates the pivot 319 and moves from the position H to position I. Here, the hinderer 318*b* rotates by a distance the same as a distance that the interferer 318*a* rotates, so it does not hinder the side cover 390 from being joined with the main body 310. Thus, the side cover 390 is joined with the main body 310.

The side cover bracket 318 is elastically biased by the elastic device (not shown), and is at the position H when the multifunctional cover 380 is opened from the main body 310. Here, the hinderer 318*b* hinders the side cover 390 from being joined with the main body 310. Thus, the side cover 390 cannot be joined with the main body 310 when the multifunctional cover 380 is not joined with the main body 310.

As described above, a multi-function machine according to the present invention includes members having functions of checking a position of a jam removal lever, checking whether a toner container locking lever is fixed, opening a shutter, and rotating a side cover bracket at a multifunctional cover. Parts added when the members are independently installed are not required. Thus, cost of the multi-function machine is reduced, and a user may easily check several functions of the multi-function machine.

What is claimed is:

1. A printer having a cover installed at a predetermined position on a main body to open or close, comprises:

a jam removal lever position checking portion to interfere with a jam removal lever installed in the main body to check whether the jam removal lever is properly positioned;

a toner container locking lever position checking portion, which is adjacent to the jam removal lever position checking portion, to interfere with a toner container locking lever installed in the main body to check whether a toner container of the printer is properly fixed;

a shutter switch, which is adjacent to the toner container locking lever position checking portion, to open and close a shutter of the printer to control a flow of remaining toner into the toner container; and a side cover bracket controller, which is installed at a predetermined position of the cover facing the main body, to interfere with a side cover bracket installed at the main body to control joining a side cover of the printer with the main body.

2. The printer of claim 1, wherein the jam removal lever position checking portion protrudes from the cover at a predetermined length, and comprises an inclined portion having a plurality of first ribs that interfere with the jam removal lever of the main body.

3. The printer of claim 2, wherein the first ribs are provided to push the jam removal lever to a predetermined position so that the cover is joined with the main body.

4. The printer of claim 3, wherein the jam removal lever is fixed at the predetermined position when the cover is joined with the main body.

5. The printer of claim 1, wherein the toner container locking lever position checking portion protrudes from the cover at a predetermined length, and comprises an inclined portion having a plurality of second ribs that interfere with the toner container locking lever of the main body.

6. The printer of claim 5, wherein the second ribs are provided to push the toner container locking lever to a predetermined position so that the cover is joined with the main body.

7. The printer of claim 6, wherein the toner container locking lever is fixed at the predetermined position when the cover is joined with the main body.

8. The printer of claim 1, wherein the shutter switch protrudes from the cover at a predetermined length, opens the shutter when the cover is closed toward the main body, and closes the shutter when the cover is opened from the main body.

9. The printer of claim 8, wherein the toner container is provided with an opening at a predetermined location in which the shutter contacts the toner container.

10. The printer of claim 1, wherein the side cover bracket controller protrudes from the cover at a predetermined length, interferes with the side cover bracket so that the side cover is joined with the main body when the cover is joined with the main body, and does not allow the side cover to be joined with the main body when the cover is opened from the main body.

11. The printer of claim 10, wherein the side cover bracket rotates about a pivot at the main body between a first and second predetermined position, and is elastically biased to a first predetermined position.

12. The printer of claim 11, wherein the main body comprises an interfering unit and a hindering unit provided at a predetermined angle at the side cover bracket.

13. The printer of claim 12, wherein the side cover bracket controller pushes the interfering unit to the second predetermined position so that the cover is joined with the main body.

14. The printer of claim 12, wherein the hindering unit hinders the side cover from joining with the main body when the side cover bracket is elastically biased to the first predetermined position, and does not hinder the side cover from joining with the main body when the side cover bracket is pushed to the second predetermined position.

15. The printer of claim 1, wherein the jam removal lever position checking portion, the toner containing locking lever position checking portion, the shutter switch, and the side cover bracket controller are integrally formed on the cover.

16. A printer having a cover installed at a predetermined position on a main body to open or close, comprising:

a jam removal lever position checking portion to interfere with a jam removal lever installed in the main body to check whether the jam removal lever is properly positioned; and a toner container locking lever position checking portion, which is adjacent to the jam removal lever position checking portion, to interfere with a toner container locking lever installed in the main body to check whether a toner container of the printer is properly fixed.

17. A printer having a cover installed at a predetermined position on a main body to open or close, comprising:

a jam removal lever position checking portion to interfere with a jam removal lever installed in the main body to check whether the jam removal lever is properly positioned; and a shutter switch, which is adjacent to a toner container locking lever position checking portion, to open and close a shutter of the printer to control a flow of remaining toner into the toner container.

18. A printer having a cover installed at a predetermined position on a main body to open or close, comprising:

a jam removal lever position checking portion to interfere with a jam removal lever installed in the main body to check whether the jam removal lever is properly positioned; and a side cover bracket controller, which is installed at a predetermined position of the cover facing the main body, to interfere with a side cover bracket installed at the main body to control joining a side cover of the printer with the main body.

19. A printer having a cover installed at a predetermined position on a main body to open or close, comprising:

a toner container locking lever position checking portion, which is adjacent to a jam removal lever position checking portion, to interfere with a toner container locking lever installed in the main body to check whether a toner container of the printer is properly fixed; and a shutter switch, which is adjacent to the toner container locking lever position checking portion, to open and close a shutter of the printer to control a flow of remaining toner into the toner container.

20. A printer having a cover installed at a predetermined position on a main body to open or close, comprising:

a toner container locking lever position checking portion, which is adjacent to a jam removal lever position checking portion, to interfere with a toner container locking lever installed in the main body to check whether a toner container of the is properly fixed; and a side cover bracket controller, which is installed at a predetermined position of the cover facing the main body, to interfere with a side cover bracket installed at the main body to control joining a side cover of the printer with the main body.

21. A printer having a cover installed at a predetermined position on a main body to open or close, comprising:

a shutter switch, which is adjacent to a toner containing locking lever position checking portion, to open and close a shutter of the printer to control a flow of remaining toner into the toner container; and a side cover bracket controller, which is installed at a predetermined position of the cover facing the main body, to interfere with a side cover bracket installed at the main body to control joining a side cover of the printer with the main body.

* * * * *

UNITED STATES PATENT AND TRADEMARK OFFICE

CERTIFICATE OF CORRECTION

PATENT NO. : 7,003,244 B2
APPLICATION NO. : 10/939397
DATED : February 21, 2006
INVENTOR(S) : Young-bok Cho It is certified that error appears in the above-identified patent and that said Letters Patent is hereby corrected as shown below:

Column 8, line 26, claim 20, after "of the", insert -- printer--.

Signed and Sealed this

Eighth Day of August, 2006

JON W. DUDAS
*Director of the United States Patent and Trademark Office*